US006817148B1

(12) United States Patent
Sorkin

(10) Patent No.: US 6,817,148 B1
(45) Date of Patent: Nov. 16, 2004

(54) CORROSION PROTECTION SEAL FOR AN ANCHOR OF A POST-TENSION SYSTEM

(76) Inventor: Felix L. Sorkin, 4115 Greenbriar Dr., P.O. Box 1503, Stafford, TX (US) 77477

( * ) Notice: Subject to any disclaimer, the term of this patent is extended or adjusted under 35 U.S.C. 154(b) by 148 days.

(21) Appl. No.: 09/649,157

(22) Filed: Aug. 28, 2000

(51) Int. Cl.[7] ..... E04C 5/08
(52) U.S. Cl. ..... 52/223.13; 52/223.14; 24/122.6
(58) Field of Search ..... 52/223.13, 223.14; 24/122.6

(56) References Cited

U.S. PATENT DOCUMENTS 4,363,462 A * 12/1982 Wlodkowski et al.
5,024,032 A * 6/1991 Rodriguez
5,072,558 A 12/1991 Sorkin et al.
5,351,366 A * 10/1994 Shaw
5,749,185 A 5/1998 Sorkin
5,770,286 A 6/1998 Sorkin
5,788,398 A 8/1998 Sorkin
5,839,235 A 11/1998 Sorkin

* cited by examiner

*Primary Examiner*—Blair M. Johnson
(74) *Attorney, Agent, or Firm*—Harrison & Egbert

(57) ABSTRACT

A post-tension anchor system including an anchor body having a polymeric encapsulation extending therearound in which the encapsulation has a tubular portion integrally formed therewith and extending outwardly from the anchor body. A tendon is affixed within a wedge-receiving cavity of the anchor body. The tendon has a sheathed portion and an unsheathed portion. A seal member is affixed to an end of the tubular portion opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body. A plurality of wedges are positioned in interference-fit relationship with the unsheathed portion of the tendon within the wedge-receiving cavity of the anchor body.

2 Claims, 3 Drawing Sheets

CORROSION PROTECTION SEAL FOR AN ANCHOR OF A POST-TENSION SYSTEM

TECHNICAL FIELD

The present invention relates to post-tensioning systems. More particularly, the present invention relates to encapsulated anchor systems which serve to maintain the tendon of the post-tension system in a corrosion resistant condition. More specifically, the present invention relates to corrosion protection tubes as used in conjunction with encapsulated anchors for such post-tension anchor systems.

BACKGROUND ART

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

A problem that affects many of the anchorage systems is the inability to effectively prevent liquid intrusion into the area of the unsheathed portion of the tendon. Normally, the unsheathed portion will extend outwardly, for a distance, from the anchor in the direction toward the dead end anchor.

In normal practice, a liquid-tight tubular member is placed onto an end of the anchor so as to cover the unsheathed portion of the tendon. The tubular member slides onto and over the trumpet portion of the encapsulated anchor so as to be frictionally engaged with the trumpet portion of the anchor. The opposite end of the tubular member will include a seal which establishes a generally liquid-tight connection with the sheathed portion of the tendon.

Unfortunately, various experiments with such systems have indicated that such "frictional en agement" between the liquid-tight tubular member and the trumpet portion of the anchor is inadequate for preventing liquid intrusion to the unsheathed portion of the tendon. In common practice, workers at the construction site will not attach the tubular member to the trumpet portion of the anchor in a suitable manner. As such, liquid will eventually migrate through the connection between the trumpet portion of the anchor and the end of the tubular member. In other circumstances, because of the stresses placed upon the tendon, the tubular member will become disengaged from this end of the anchor. In other circumstances, workers will step on the tubular member during the installation of the anchorages such that the tubular member becomes dislodged from the trumpet portion of the anchor. In all of these circumstances, the "frictional engagement" between the tubular member and the trumpet portion of the anchor provides an inadequate connection.

In the past, the present inventor has developed various systems of corrosion protection for such post-tension systems. Each of these prior inventions by this present inventor are represented by the following patents. U.S. Pat. No. 5,839,235, issued on Nov. 24, 1998, teaches a post-tension anchor system having a trumpet portion extending outwardly therefrom. A tubular body is affixed in snap-fit engagement with the trumpet portion so as to extend outwardly from this trumpet portion in axial alignment therewith. The tubular body has a seal at an end opposite the trumpet portion so as to form a generally liquid-tight seal with an exterior surface of the tendon.

U.S. Pat. No. 5,788,398, issued on Oct. 4, 1998, describes a connector for joining a corrosion-protection tube to an anchor of a tendon of a post-tension system. This connector includes a body formed of an elastomeric material and a seal formed interior of the body. The body has a first receptacle formed at one end thereon for attachment to an end of the anchor. The body has a second receptacle formed at an opposite end thereof for attachment to an end of the corrosion-protection tube. A seal is positioned between the first receptacle and the second receptacle so as to form a liquid-tight seal with a surface of the tendon passing therethrough. The first receptacle is an orifice that has a diameter suitable for liquid-tight engagement with an end of the anchor. The second receptacle is an opening formed in the opposite end of the body and has a diameter suitable for liquid-tight engagement with an exterior surface of the corrosion-protection tube.

U.S. Pat. No. 5,440,842, issued on Aug. 15, 1995, describes an apparatus for sealing an anchor. The apparatus includes a vessel member having a void and a rust inhibitor disposed within the void. A retaining member is permanently affixed to the vessel member whereby the retaining member is punctured by the tendon end upon placing the vessel in sealed communication with the anchor.

U.S. Pat. No. 5,770,286, issued on Jun. 23, 1998, teaches a seal for use on a tubular member in a post-tension construction. The seal includes a cap having a tubular body and a surface extending across the end of the tubular body. A corrosion-resistant material is contained within the interior area of the cap. The surface has a frangible area formed thereon. The surface extends transverse to the longitudinal axis of the tubular body at one end of the tubular body. The corrosion-resistant material is contained within the cap of a suitable volume so as to fill a void in the tubular member between the inner diameter of the tubular member and the outer diameter of a tendon extending therethrough.

U.S. Pat. No. 5,897,102, issued on Apr. 27, 1999, teaches a pocket former apparatus for a post-tension anchor system. This pocket former apparatus includes a connector arrangement which can extend over the unsheathed and sheathed surfaces of the tendon extending therethrough. A seal is provided at the end of a tubular member connected to the trumpet portion of the anchor so as to provide a liquid-tight seal over the sheathed portion of the tendon.

U.S. Pat. No. 6,023,894; issued on Feb. 15, 2000, describes a post-tension anchor having an improved cap connector. A polymeric encapsulation covers the anchor member and has a tubular section extending outwardly from this end surface of the anchor member. An improved cap is provided which has a generally tubular body with an open end and a closed end. The tubular section of the encapsulation includes an inwardly extending protrusion. A locking member is formed on the circumferential surface for detachably engaging the protrusion such that the flanged end is fixedly received within the tubular section of the encapsulation. A compressible seal is affixed within the polymeric encapsulation and extends around the end surface.

It is an object of the present invention to provide an anchor which includes a seal for providing liquid-tight engagement with a tendon extending through the anchor.

It is a further object of the present invention to provide an anchor for a post-tension system which allows a seal to be placed easily onto one end of the anchor.

It is still a further object of the present invention to provide an improved encapsulation for a post-tension system in which a seal member can be positively interlocked at an end of the tubular portion of the anchor encapsulation.

It is still a further object of the present invention to provide a sealing apparatus for a post-tension system which is easy to manufacture, easy to use, and relatively inexpensive.

These and other objects and advantages of the present invention will become apparent from a reading of the attached specification and appended claims.

SUMMARY OF THE INVENTION

The present invention is a post-tension anchor system comprising an anchor body having a polymeric encapsulation extending therearound, a tendon affixed within a wedge-receiving cavity of the anchor body, and a seal member affixed to an end of a tubular portion extending outwardly from the encapsulation of the anchor body. The tubular portion of the encapsulation is integrally formed with the encapsulation and extends outwardly from one end of the anchor body. The tendon has a sheathed portion and an unsheathed portion. The seal member has a portion extending around the sheathed portion of the tendon in generally liquid-tight relationship therewith.

In the present invention, the tubular portion has an interlock area extending therearound. The interlock area engages an interior surface of the seal member. In one form of the present invention, the interlock area comprises a protrusion extending annularly around the tubular portion adjacent to the end of the tubular portion. This protrusion engages an indentation formed on the interior surface of the seal member. In another form of the present invention, the interlock area includes an indentation extending around the tubular portion adjacent to the end of the tubular portion. The seal member includes a protrusion extending inwardly from the interior surface of the seal member. The indentation receives the protrusion therein.

In the present invention, the seal member comprises a first annular portion extending around the tubular portion and a second annular portion extending outwardly from the first annular portion. The second annular portion is in liquid-tight relationship with the sheathed portion of the tendon. The second annular portion has a diameter smaller than a diameter of the first annular portion. The seal member is formed of an elastomeric material.

In the present invention, the tubular portion has a length of greater than four inches extending outwardly from this anchor body. Preferably, the tubular portion will have a length of between four inches and six inches.

A plurality of wedges are in interference-fit relationship with the unsheathed portion of the tendon within the wedge-receiving cavity of the anchor body.

DETAILED DESCRIPTION OF THE INVENTION

Figure 1:
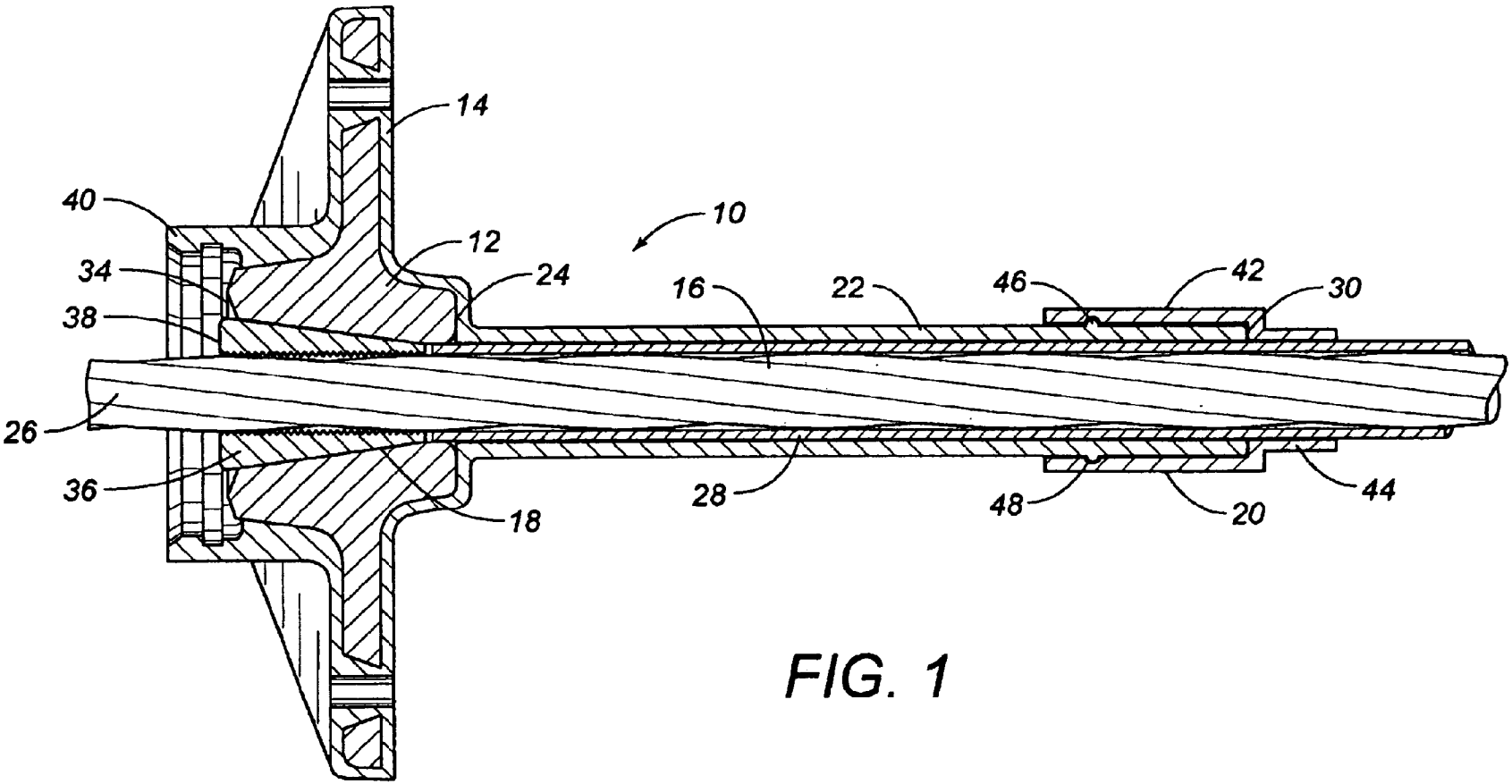
FIG. 1 is a cross-sectional view of the post-tension anchorage system of the present invention.

Referring to FIG. 1, there is shown at 10 the post-tension anchorage system, in accordance with the teachings of the present invention. The post-tension anchorage system 10 includes an anchor body 12 having a polymeric encapsulation 14 extending therearound, a tendon 16 affixed within the wedge-receiving cavity 18 of the anchor body 12, and a seal member 20 affixed to an end of the tubular portion 22 of the encapsulation 14 of the anchor body 12. The tubular portion 22 is integrally formed with the encapsulation 14 and extends outwardly from an end 24 of the anchor body 12. The tendon 16 includes an unsheathed portion 26 and a sheathed portion 28. The seal member 20 is affixed to the end 30 of the tubular portion 22. The seal member 20 has a portion 32 extending around the sheathed portion 28 of the tendon 16 in generally liquid-tight relationship therewith.

In the present invention, the anchor body 12 has a generally standard form of steel anchor therein. The anchor body 12 includes the wedge-receiving cavity which tapers from one end 34 of the anchor body 12 toward the opposite end 24 of the anchor body 12. Wedges 36 and 38 are fitted within the wedge-receiving cavity 18 so as to be in interference-fit relationship between the unsheathed portion 26 of the tendon 16 and the wall of the tapered cavity 18. Conventionally, the tendon 16 will be suitably tensioned so that the wedges 36 and 38 are drawn into their interference-fit position.

The polymeric encapsulation 14 is injection molded around the anchor body 12. The polymeric encapsulation 14 has a cap section 40. Cap section 40 is suitable for receiving a cap therein which closes the end of the anchor body 12.

The encapsulation 14 is formed of a polymeric material. This encapsulation 14 serves to hermetically seal the steel anchor body 12 therein. A tubular portion 22 of the encapsulation 14 is integrally connected and formed with the encapsulation 14 and extends outwardly from the end 24 of the anchor body 12 by at least four inches. In the preferred embodiment of the present invention, this tubular portion extends outwardly from between four and six inches. The length of the tubular portion 22 is much greater than that found on the prior art encapsulated anchor systems. The reason for the extended length of the tubular portion 22 is to accommodate the unsheathed portion 26 of the tendon 16 therein. During the tensioning of the tendon 16, the unsheathed portion 26 will extend for a distance beyond the narrow end of the wedges 36 and 38 within the wedge-receiving cavity 18. If the length of the tubular portion 22 is too short, then an unsheathed portion may emerge beyond the portion 32 of the seal member 20. The extended length of the tubular portion 22 eliminates the requirements for the attachment of additional tubular members (such as those shown in the various prior art patents by the present inventor). The tubular portion 22 can be formed during the injection molding of the encapsulation 14 around the anchor body 12.

The seal member 20 has a first annular portion 42 extending around the tubular portion 22 at the end 30. The seal member 20 also has a second annular portion 44 extending outwardly from this first annular portion 42. The second annular portion 44 is in liquid-tight sealing relationship with the sheathed portion 28 of the tendon 16. The second annular portion 44 has a diameter smaller than the diameter of the first annular portion 42. The seal member 20 is formed of elastomeric material.

In FIG. 1, it can be seen that an interlock 46 is formed on the outer surface of the tubular portion 22. The interlock 46 is a protrusion which extends radially around the outer surface of the tubular portion 22 adjacent to the end 30. Similarly, the inner surface of the seal member 20 includes an indentation 48 extending therearound. When the seal member 20 is placed over the end 30 of the tubular portion 22, the protrusion 46 will be received within the indentation 48 on the seal member 20. As such, a positive interlock is formed between the seal member 20 and the tubular portion 22 so as to assure that the seal member 20 is properly positioned on the ends 30 of the tubular portion 22. This arrangement of protrusion 46 and indentation 38 assures that the seal member 20 will not inadvertently become dislodged from the end 30 of the tubular portion 22. Also, if the protrusion 46 should be visually observable by workers or inspectors as extending outwardly from the seal member 20, then it would be a positive indication to the workers or inspectors that the seal member 20 had been improperly installed over the end 30 of the tubular portion 22. As can be seen, the relationship between the seal member 20 and the end 30 of the tubular portion 22 will resist any liquid intrusion into the interior area of the tubular portion 22 or toward the unsheathed portion 26 of tendon 16 or toward the steel anchor body 12.

Figure 2:
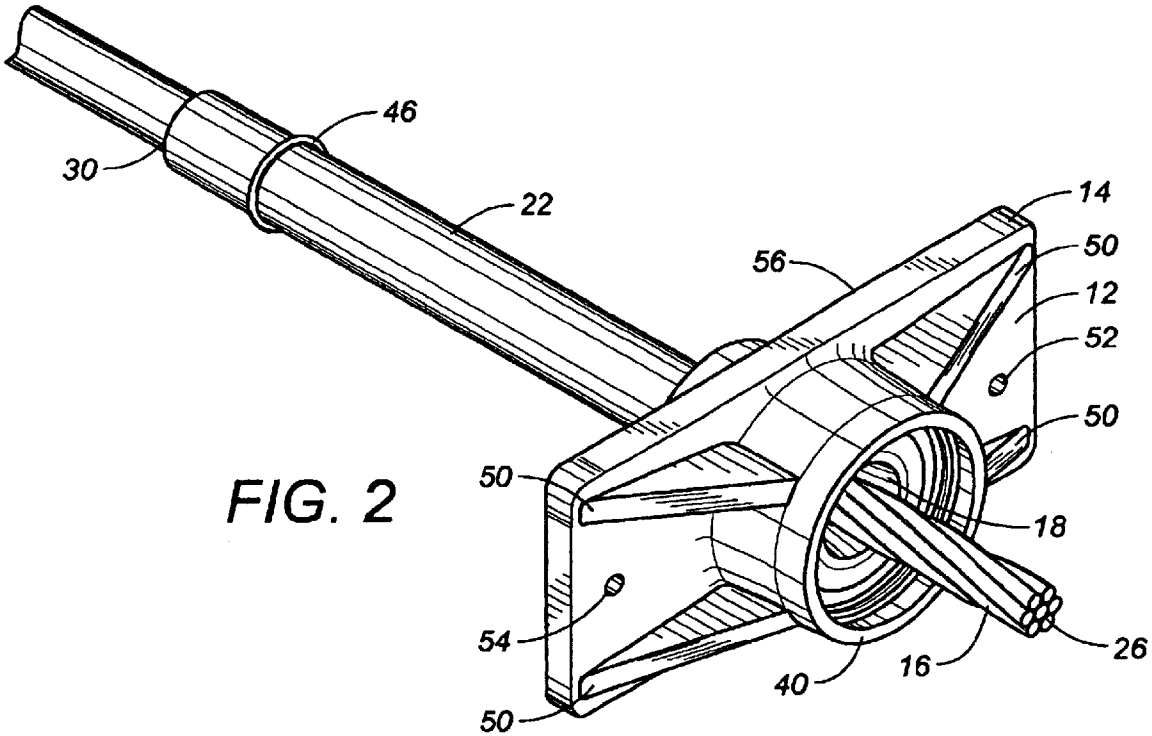
FIG. 2 is a perspective view of the encapsulated anchor as used within the present invention.

FIG. 2 is a perspective view of the anchor system as used in the present invention. As can be seen in FIG. 2, the anchor body 12 is covered with a polymeric encapsulation 14. The anchor body 12 has a generally cylindrical section 40 which extends outwardly from the flat plate of the anchor body 12. The unsheathed portion 26 of the tendon 16 is illustrated as extending outwardly of this cylindrical section 40 of the anchor body 12. The wedge-receiving cavity 18 is illustrated as extending inwardly into the anchor body 12. Various gussets 50 extend radially outwardly of the cylindrical section 40. Holes 52 and 54 allow the anchor body 12 to be appropriately nailed to a form board or to other objects.

In FIG. 2, it can be seen that the tubular portion 22 extends outwardly from the back surface 56 of the anchor body 12. Tubular portion 22 includes protrusion 46 adjacent to the end 30 of the tubular portion 22. The tubular portion 22 will, preferably, have a length of greater than four inches as extending from this back surface 56 of the anchor body 12. In FIG. 2, the seal member 20 is not illustrated.

Figure 3:
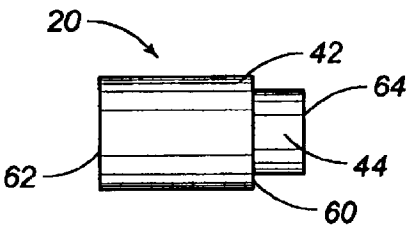
FIG. 3 is a side elevational view of the seal member as used in the present invention.

FIG. 3 is an isolated view of the seal member 20. As can be seen, the seal member 20 includes a first annular portion 42 and a second annular portion 44 extending outwardly from an end 62 of first annular portion 42. The second annular portion 44 is in sealing relationship with the first annular portion 42. The end 62 of the first annular portion 42 is open so as to allow the seal member 20 to be affixed over the end 30 and onto the protrusion 46 of the tubular portion 22. An opening 64 is formed in the end of the second annular portion 44 opposite the end 62. The opening 64 has a suitable size so as to allow the sheathed portion 28 of the tendon 16 to extend therethrough in liquid-tight relationship.

Figure 4:
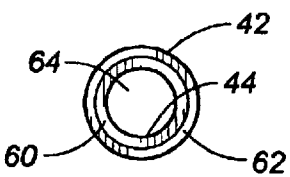
FIG. 4 is an end view of the seal member as used in the present invention.

In FIG. 4, the end 62 of the first annular portion 42 is particularly illustrated. It can be seen that a wall 60 extends between the first annular portion 42 to the second annular portion 44. Opening 64 of the second annular portion 44 is also shown.

Figure 5:
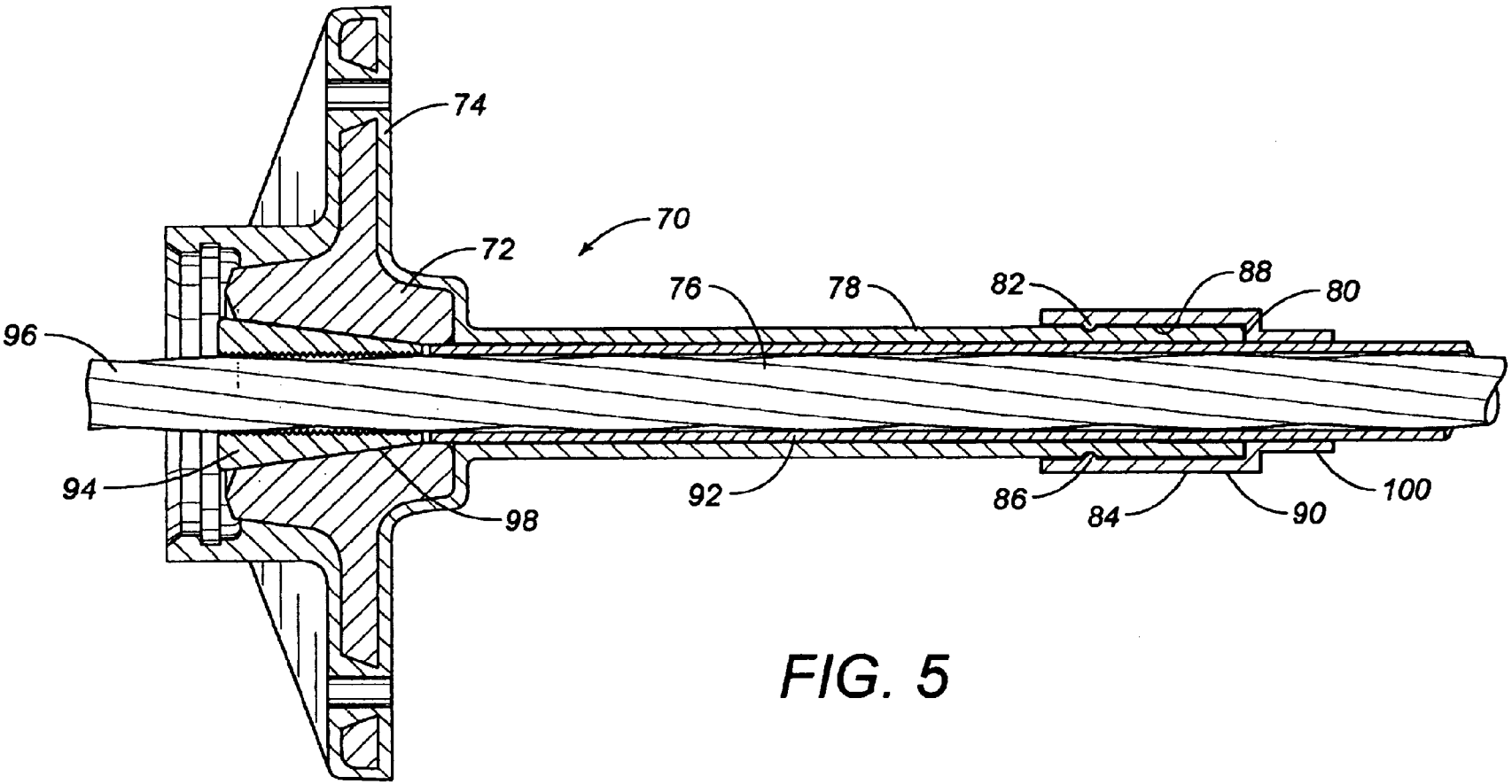
FIG. 5 is a cross-sectional view of an alternative embodiment of the post-tension anchorage system in accordance with the teachings of the present invention.

FIG. 5 shows an alternative form of the present invention. The post-tension anchor system 70, as illustrated in FIG. 5, includes the anchor body 72, the encapsulation 74, the tendon 76 and the tubular portion 78 of a generally identical configuration to that shown in FIG. 1. The only significant difference is at the end 80 of the tubular portion 78. In FIG. 5, there is shown an indentation 82 which extends around and into the surface of the tubular portion 78. The seal member 84 has a similar configuration to that shown in FIG. 1 except for the protrusion 86 which extends inwardly from this inner wall 88 of the first annular portion 90 of the seal member 80. The protrusion 86 extending inwardly from the wall 88 will engage the indentation 82 formed in the tubular portion 78 so as to provide the positive interlock between the seal member 80 and the tubular portion 78.

In actual use, the tendon 76 will be suitably tensioned so that the sheathing 92 is drawn toward the anchor body 72. When the tensioned tendon 76 is released, the wedges 94 will grip the unsheathed portion 96 of the tendon 76 so as to draw the wedges 94 inwardly of the wedge cavity 98 so that the wedges 84 will reside in interference-fit relationship within the wedges cavity 98 and against the unsheathed portion 96 of the tendon 76.

After the tensioned tendon is released, the sheathed portion 92 will tend to spring slightly toward the end 80 of the tubular portion 78. As such, the tubular portion 78 has a sufficient length so as to accommodate any retraction of the sheathing 92. The tubular portion 78 is designed to be of such a length so as to accommodate the elasticity of the tendon 76 so as to prevent the sheathing 92 from emerging outwardly of the end 100 of the seal member 84. The present invention provides a perfect seal against the intrusion of contaminating materials into the exposed surfaces within the anchor body 72 or on the tendon 76.

The foregoing disclosure and description of the invention is illustrative and explanatory thereof. Various changes in the details of the illustrated construction may be-made within the scope of the appended claims without departing from the true spirit of the invention. The present invention should only be limited by the following claims and their legal equivalents.

I claim:

1. A post-tension anchor system comprising:

an anchor body having a polymeric encapsulation extending therearound, said encapsulation having a tubular portion integrally formed therewith and extending outwardly from one end of said anchor body, said anchor body having a wedge-receiving cavity formed therein, said tubular portion having an interlock area extending around an exterior surface thereof, said interlock area comprising a protrusion extending outwardly and around said tubular portion adjacent an end of said tubular portion opposite said anchor body;

a tendon affixed within said wedge-receiving cavity of said anchor body, said tendon having a sheathed portion and an unsheathed portion;

a seal member affixed to an end of said tubular portion opposite said anchor body, said seal member extending around said sheathed portion of said tendon in generally liquid-tight relationship therewith, said protrusion engaging an indentation formed on an interior surface of said seal member, said seal member comprising:

a first annular portion extending around said tubular portion at said end; and a second annular portion extending outwardly from said first annular portion, said second annular portion being in liquid-tight relationship with said sheathed portion of said tendon, said second annular portion having a diameter smaller than a diameter of said first annular portion, said second annular portion extending outwardly of said end of said tubular portion, said seal member being formed of an elastomeric material, said tubular portion having a length of greater than four inches extending outwardly of said anchor body; and a plurality of wedges in interference-fit relationship with said unsheathed portion of said tendon within said wedge-receiving cavity of said anchor body.

2. An anchor system for a post-tension anchorage system comprising:

an anchor body having a polymeric encapsulation extending thereover, said encapsulation having a tubular portion integrally formed therewith and extending outwardly from one end of said anchor body for greater than four inches, said anchor body having a wedge-receiving cavity formed therein, said tubular portion having an indentation extending therearound adjacent an end of said tubular portion opposite said anchor body, said tubular portion being in co-axial longitudinal alignment with said wedge-receiving cavity;

a tendon affixed within said wedge-receiving cavity of said anchor body, said tendon extending through said tubular portion, said tendon having a sheathed portion and an unsheathed portion, only said sheathed portion extending outwardly of an end of said tubular portion opposite said anchor body; and a seal member affixed to an end of said tubular portion opposite said anchor body, said seal member having an interior opening of a diameter less than a diameter of said wedge-receiving cavity, said seal member comprising:

first annular portion extending around said tubular portion at said end, said first annular portion having a protrusion extending inwardly from an inner wall of said first annular portion, said protrusion received by said indentation of said tubular portion; and a second annular portion extending from said first annular portion, said second annular portion having a diameter smaller than a diameter of said first annular portion, said second annular portion extending outwardly of said end of said tubular portion.

* * * * *